US009176459B2

(12) United States Patent
Nakashima

(10) Patent No.: US 9,176,459 B2
(45) Date of Patent: Nov. 3, 2015

(54) IMAGE FORMING APPARATUS

(75) Inventor: Atsuhisa Nakashima, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 266 days.

(21) Appl. No.: 13/613,131

(22) Filed: Sep. 13, 2012

(65) Prior Publication Data

US 2013/0077990 A1 Mar. 28, 2013

(30) Foreign Application Priority Data

Sep. 28, 2011 (JP) ..... 2011-212988

(51) Int. Cl.
*G03G 15/00* (2006.01)
*G03G 21/16* (2006.01)

(52) U.S. Cl.
CPC ..... *G03G 21/1619* (2013.01)

(58) Field of Classification Search
CPC ..... G03G 21/1619
USPC ..... 399/107
See application file for complete search history.

(56) References Cited

U.S. PATENT DOCUMENTS

| | | | | |
|---|---|---|---|---|
| 5,331,374 | A | 7/1994 | Abe et al. | |
| 6,928,251 | B2 | 8/2005 | Yoshihara et al. | |
| 7,706,716 | B2 | 4/2010 | Tada et al. | |
| 7,783,226 | B2 | 8/2010 | Tomatsu | |
| 7,894,743 | B2 | 2/2011 | Tomatsu | |
| 7,982,761 | B2 | 7/2011 | Yokoi | |
| 8,073,356 | B2 | 12/2011 | Nakashima | |
| 2004/0095456 | A1 | 5/2004 | Yoshihara et al. | |
| 2007/0160382 | A1* | 7/2007 | Tomatsu | 399/107 |
| 2008/0002341 | A1* | 1/2008 | Tomatsu | 361/679 |
| 2008/0075502 | A1 | 3/2008 | Tada et al. | |
| 2009/0169261 | A1 | 7/2009 | Yokoi | |
| 2009/0245849 | A1* | 10/2009 | Nakashima | 399/92 |
| 2010/0014887 | A1* | 1/2010 | Tomatsu et al. | 399/107 |
| 2010/0080612 | A1* | 4/2010 | Nakashima | 399/111 |
| 2010/0135684 | A1* | 6/2010 | Nakagawa | 399/51 |

FOREIGN PATENT DOCUMENTS

| | | | |
|---|---|---|---|
| CN | 101105658 | A | 1/2008 |
| JP | 05-181326 | A | 7/1993 |
| JP | 06-035243 | A | 2/1994 |
| JP | 2002-278198 | A | 9/2002 |

(Continued)

OTHER PUBLICATIONS

Office Action received in corresponding Chinese Application No. 201210358581.7 mailed Oct. 10, 2014.

(Continued)

*Primary Examiner* — David Gray
*Assistant Examiner* — Thomas Giapaolo, II
(74) *Attorney, Agent, or Firm* — Banner & Witcoff, Ltd.

(57) ABSTRACT

An image forming apparatus, including an image forming unit configured to form an image on a recording medium, a pair of resin frames configured to support the image forming unit at least partially from mutually opposite sides, a pair of metal-made upper enhancing pieces arranged along upper faces of the resin frames, and a pair of first metal beams, each of which is arranged to bridge over a position between the paired upper enhancing pieces and forms a four-sided opening in conjunction with each other and with the paired upper enhancing pieces, is provided.

16 Claims, 5 Drawing Sheets

(56) References Cited

FOREIGN PATENT DOCUMENTS

| | | | |
|---|---|---|---|
| JP | 2004-077788 | A | 3/2004 |
| JP | 2007-148142 | A | 6/2007 |
| JP | 2008-009262 | A | 1/2008 |
| JP | 2008-065122 | A | 3/2008 |
| JP | 2009-157142 | A | 7/2009 |
| JP | 2009-237316 | A | 10/2009 |
| JP | 2010-026152 | A | 2/2010 |

OTHER PUBLICATIONS

Jun. 23, 2015—(JP) Notification of Reasons for Rejection—App 2011-212988, Eng Tran.

* cited by examiner

IMAGE FORMING APPARATUS

CROSS REFERENCE TO RELATED APPLICATION

This application claims priority from Japanese Patent Application No. 2011-212988, filed on Sep. 28, 2011, the entire subject matter of which is incorporated herein by reference.

BACKGROUND

1. Technical Field

An aspect of the present invention relates to an image forming apparatus with an image forming unit for forming an image on a recording medium. More specifically, the present invention relates to an image forming apparatus including a pair of resin frames to support at least a part of the image forming unit at laterally opposite sides.

2. Related Art

An image forming apparatus for forming an image on a recording medium in an electro-photographic method may often have a pair of metal frames (e.g., steel plates), which support an image forming unit at laterally opposite sides (e.g., right and left sides). The metal frames may often increase manufacturing cost and weight of the image forming apparatus. Therefore, the metal frames may be replaced with resin frames. However, the resin frames may not provide substantial rigidity to hold the image forming unit but may be more deformable to external force than the metal frames.

In order to reinforce the less rigid resin frame, steel-made coupling members to support the resin frames may be provided to bridge between the resin frames. For example, the image forming apparatus may have a pair of resin frames to hold the image forming unit and three steel-made flat bars bridged between the resin frames to support the resin frames together from inside.

SUMMARY

Even with the metal bars bridged between the resin frames, however, distortion of the resin frames still may not be avoided at intermediate areas between coupled areas, in which the coupling bars are directly attached to the resin frames. In other words, substantial rigidity may not be provided by the resin frames with the coupling bars. Substantial rigidity may be achieved if a piece of resin plate to cover an entire plane of each resin frame may be attached to the resin frames; however, such enhancing structure may increase manufacturing cost and weight of the image forming apparatus.

In view of the difficulty, the present invention is advantageous in that an image forming apparatus having a pair of resin frames, which support at least a part of an image forming unit at laterally opposite sides, is provided whilst rigidity of an entire frame assembly of the image forming apparatus, including the resin frames, is maintained and an amount of metal to be used in the frame assembly is minimized.

According to an aspect of the present invention, an image forming apparatus is provided. The image forming apparatus includes an image forming unit configured to form an image on a recording medium, a pair of resin frames configured to support the image forming unit at least partially from mutually opposite sides, a pair of resin frames configured to support the image forming unit at least partially from mutually opposite sides, and a pair of first metal beams, each of which is arranged to bridge over a position between the paired upper enhancing pieces to bridge the paired upper enhancing pieces and forms a four-sided opening in conjunction with each other and with the paired upper enhancing pieces.

BRIEF DESCRIPTION OF THE ACCOMPANYING DRAWINGS

DETAILED DESCRIPTION

Figure 1:
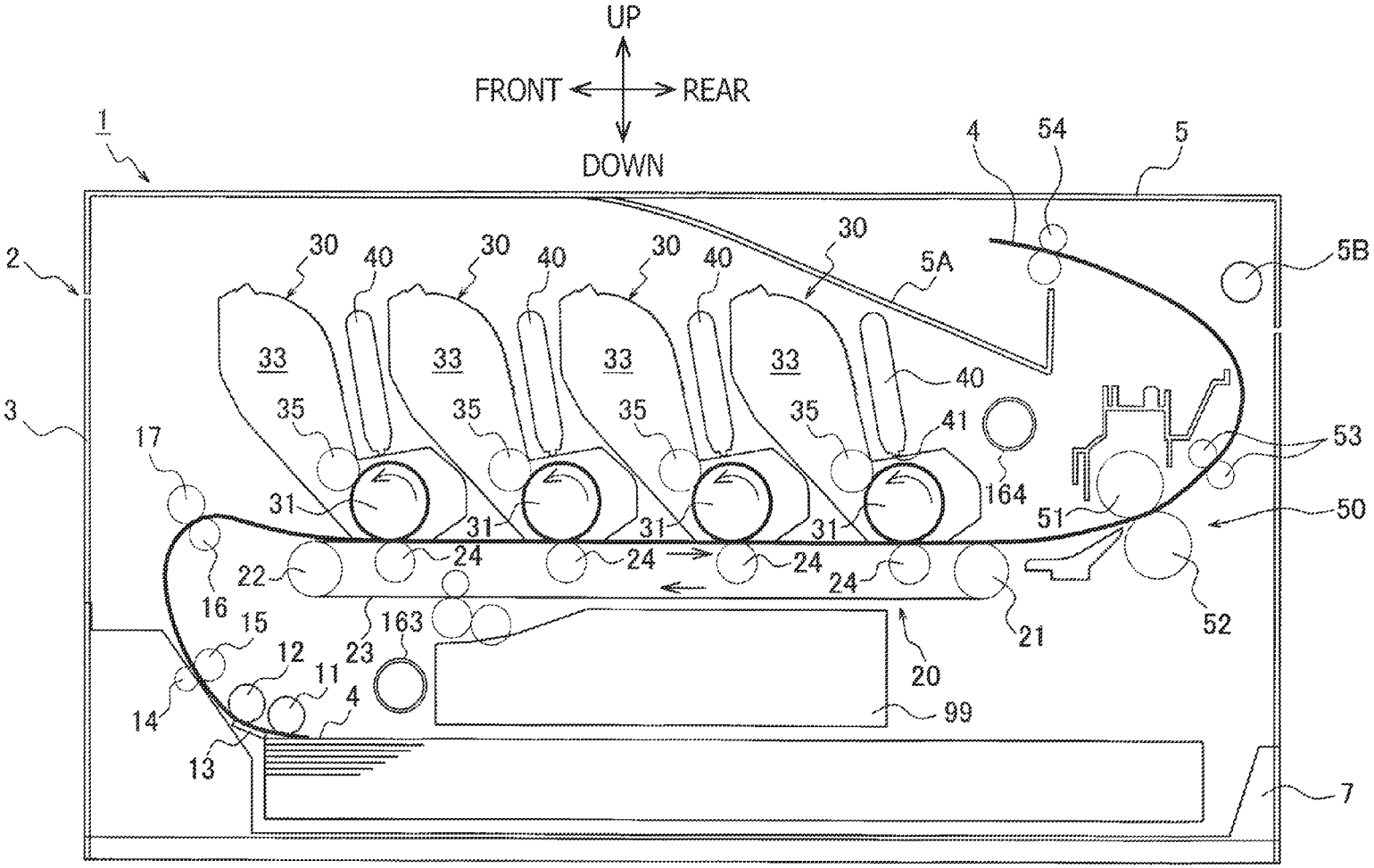
FIG. 1 is a cross-sectional side view of an image forming apparatus according to an embodiment of the present invention.

Hereinafter, an embodiment according to an aspect of the present invention will be described with reference to the accompanying drawings. FIG. 1 is a cross-sectional side view of an image forming apparatus 1 according to an embodiment of the present invention. In the following description, directions concerning the image forming apparatus 1 will be referred to based on the orientation indicated by arrows shown in each drawing. For example, a viewer's left-hand side in FIG. 1 is referred to as front for the image forming apparatus 1, and a viewer's nearer side will is referred to as right.

Overall Configuration of the Image Forming Apparatus

The image forming apparatus 1 is a color printer capable of forming multi-colored images on a sheet 4 being a recording medium in a direct-transfer tandem method as the sheet 4 is carried in a sheet-conveyer path along a sheet-conveying direction. The sheet-conveying direction, which therefore coincides with the sheet-conveyer path, is indicated in a thick winding line in FIG. 1. A direction of width of the sheet 4 is orthogonal to the sheet-conveying direction and coincides with a right-left (widthwise) direction of the image forming apparatus 1. The image forming apparatus 1 includes, as shown in FIG. 1, a box-shaped chassis 2 having a front cover 3. The chassis 2 is formed to have a discharge tray 5A, in which the sheet 4 with the image formed thereon is discharged, in an upper part thereof. The chassis 2 further includes a top cover 5, which covers the upper part of the image forming apparatus 1 including the discharge tray 5A from above. The top cover 5 is pivotable about a shaft 5B, which is arranged at an upper rear position in the image forming apparatus 1. When the top cover 5 pivotably opens, an internal structure in the chassis 2 is exposed, and processing units 30 and a belt unit 20 can be pulled upward and removed out of the chassis 2.

In a lower position in the chassis 2, a sheet-feed tray 7, in which the sheet 4 is stored, is removably installed. In the sheet-feed tray 7, an uplifting plate (not shown) is arranged. The sheet 4 is placed on the uplifting plate in the sheet-feed tray 7 and can be lifted upward by the uplifting plate at a front end portion thereof when the sheet-feed tray 7 is installed in the chassis 2. Further, in an upper front position with respect to the sheet-feed tray 7, a feeder roller 11 is arranged. The feeder roller 11 picks up the sheet 4 from the sheet-feed tray 7 and conveys the sheet 4 along the sheet-conveying direction. In a downstream position with respect to the feeder roller 11 along the sheet-conveying direction, a separator roller 12 and a separator pad 13 are arranged.

By the separator roller 12 and the separator pad 13, a topmost sheet 4 in the sheets 4 on the sheet-feed tray 7 is separated from remaining sheets 4 and conveyed in the sheet-conveying direction by a dust-remover roller 14 and a paired roller 15 toward a position between register rollers 16, 17. The register rollers 16, 17 catch the sheet 4 and convey the sheet 4 to a position above the belt unit 20, which is in a rearward position with respect to the register rollers 16, 17, according to a predetermined timing.

The belt unit 20 is removably installed in the chassis 2 and includes a belt driving roller 21, a tension roller 22, and a conveyer belt 23. The belt driving roller 21 and the tension roller 22 are arranged in rearward and frontward positions respectively to be spaced apart from each other, and the conveyer belt 23 being a transfer/conveyer belt is extended horizontally to roll around the belt-driving roller 21 and the tension roller 22. The conveyer belt 23 is an endless belt made of resin (e.g., polycarbonate). As the belt-driving roller 21 rotates, the conveyer belt 23 rolls around the belt-driving roller 21 and the tension roller 22 in a clockwise direction in FIG. 1. Accordingly, the sheet 4 on an upper surface of the conveyer belt 23 is conveyed toward the rear side of the image forming apparatus 1.

Image Forming Unit

In between the upper part and a lower part of the conveyer belt 23, four transfer rollers 24 are arranged in line along a front-rear direction in evenly spaced-apart positions from one another. The transfer rollers 24 are arranged to face photosensitive drums 31 in the processing units 30 across the upper part of the conveyer belt 23. When a toner image is transferred onto the sheet 4, which will be described later in detail, a predetermined amount of transfer currency is conducted between the transfer rollers 24 and the photosensitive drums 31 to apply transfer bias.

Images in multiple colors are formed on the sheet 4 by processing units 30 and LED units 40. In the image forming apparatus 1, four processing units 30 are arranged along the sheet-conveying direction. Each processing unit 30 is paired with an LED unit 40 and forms images in one of four colors (e.g., black, yellow, magenta, and cyan). Each LED unit 40 has an exposure head 41, in which LEDs are arranged in line along the direction of sheet-width, in a lower end thereof. Meanwhile, each processing unit 30 has a photosensitive drum 31, a toner container 33, and a developer roller 35. The photosensitive drum 31 has a metal-made and grounded drum body, which is coated with a positively-chargeable photosensitive layer. The photosensitive drum 31 and the exposure head 41 are placed in proximate positions to face each other. The circumferential surface of the photosensitive drum 31 is positively charged evenly by a charger wire (not shown) and selectively exposed to light emitted from the exposure head 41 of the LED unit 40 as the photosensitive drum 31 rotates. Thus, a latent image, which corresponds to the image to be formed on the sheet 4, is formed on the exposed region on the circumferential surface of the photosensitive drum 31.

The toner container 33 contains positively-chargeable non-magnetic monocomponent toner (not shown) in one of black, yellow, magenta, and cyan colors. The toner in the toner container 33 is positively charged as the developer roller 35 rotates and is applied evenly in a layer on a circumference of the developer roller 35. As the developer roller 35 rotates further, the toner on the circumference contacts the photosensitive drum 31 and is supplied to the latent image formed on the circumference of the photosensitive drum 31. Accordingly, the toner adheres to the latent image on the photosensitive drum 31, and a toner image corresponding to the latent image is developed on the photosensitive drum 31.

The toner image is thereafter transferred onto the sheet 4 being conveyed on the conveyer belt 23 by the transfer bias as the conveyer belt 23 with the sheet 4 thereon passes through an intermediate position between the photosensitive drum 31 and the transfer roller 24. The images in the four colors are thus layered on the sheet 4 being conveyed. The sheet 4 with the multi-layered toner images is forwarded to a fixing unit 50.

The fixing unit 50 is arranged in a rearward position with respect to the conveyer belt 23 in the chassis 2. The fixing unit 50 includes a heat roller 51 and a pressure roller 52. The heat roller 51 includes a heat source (not shown) such as a halogen lamp and is driven to rotate. The pressure roller 52 is arranged in a lower position with respect to the heat roller 51 to face the heat roller 51 and to be pressed against a circumference of the pressure roller 52. The pressure roller 52 rotates along with the rotation of the heat roller 51. When the sheet 4 with the multi-colored toner images passes through an intermediate position between the heat roller 51 and the pressure roller 52, heat from the heat roller 51 is conducted to the toner images, and the toner images are thermally fixed onto the sheet 4. The sheet 4 with the fixed toner images is conveyed further in the sheet-conveyer path by conveyer rollers 53 arranged at upper rear positions with respect to the fixing unit 50. Thereafter, the sheet 4 is discharged in the discharge tray 5A by discharge rollers 54, which are arranged in upper positions in the chassis 2.

The image forming apparatus 1 includes a known belt cleaner 99 to clean an outer surface of the conveyer belt 23. The belt cleaner 99 is arranged in a position to contact a lower outer surface of the conveyer belt 23 which is extended to roll around the belt-driving roller 21 and the tension roller 22.

In the image forming apparatus 1, as has been mentioned above, the top cover 5 is pivotable about the shaft 5B. To a lower surface of the top cover 5, which faces downward when the top cover 5 is in a closed position (FIG. 1), the LED units 40 are coupled via connection links (not shown). Therefore, when the top cover 5 is pivoted to open, the LED units 40 are uplifted along with the top cover 5 to uplifted positions (not shown) and separated from the photosensitive drums 31. When the top cover 5 is closed, the LED units 40 are placed in the positions proximate to the photosensitive drums 31.

Frame Assembly in the Image Forming Apparatus

Figure 2:
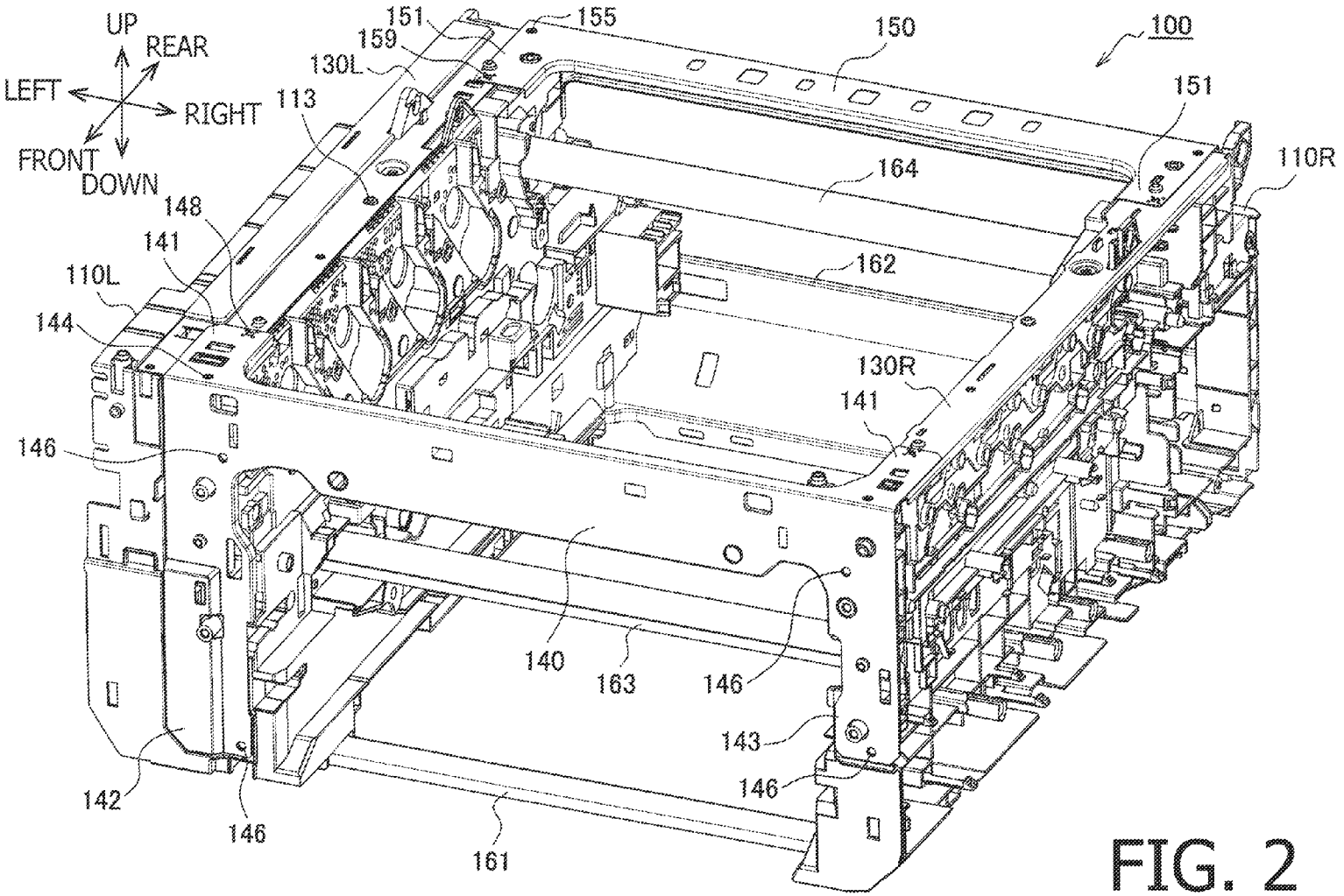
FIG. 2 is a perspective view of a frame assembly in the image forming apparatus according to the embodiment of the present invention.
Figure 3:
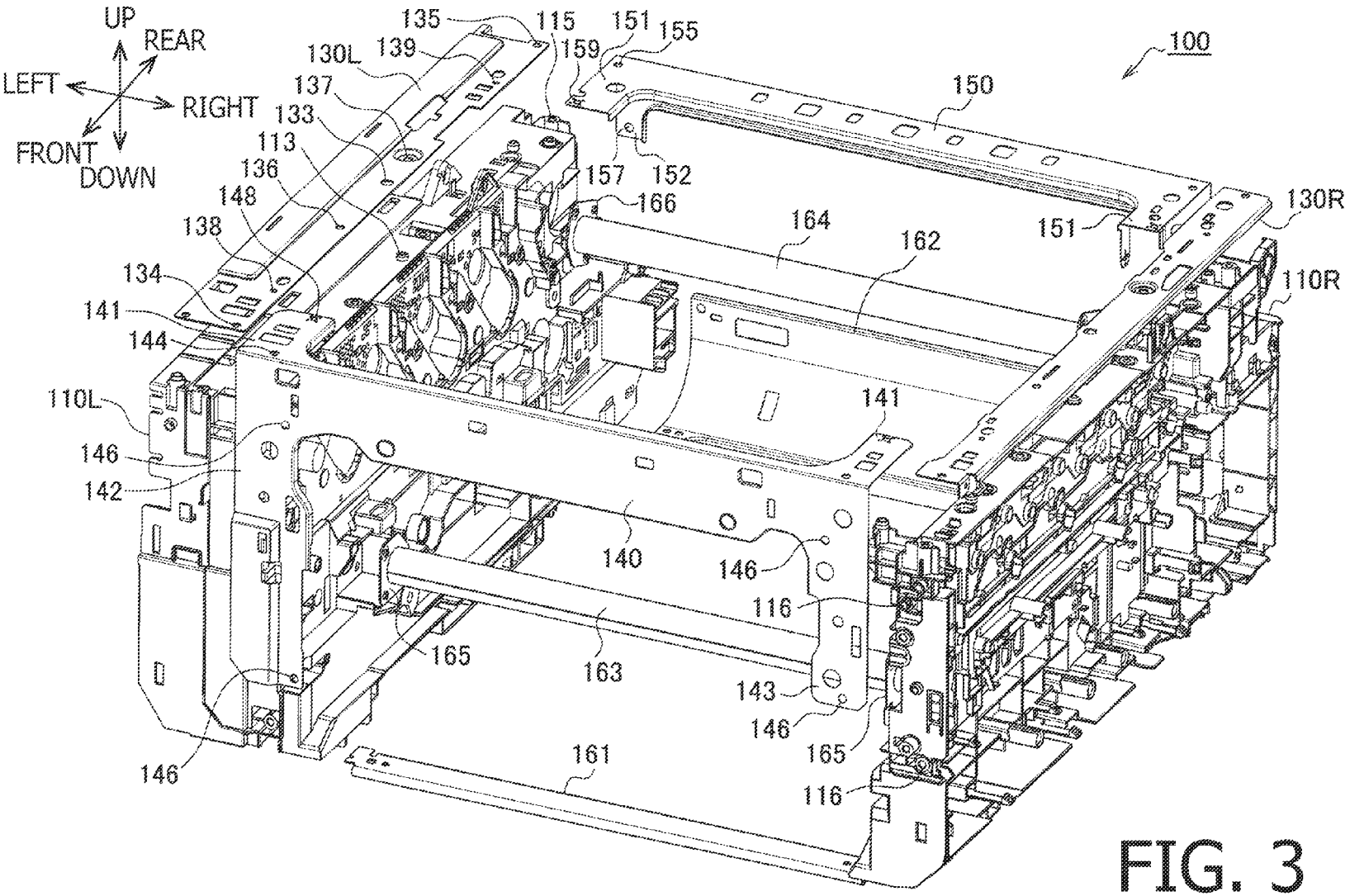
FIG. 3 is a perspective view of a front side of the frame assembly in the image forming apparatus according to the embodiment of the present invention.
Figure 4:
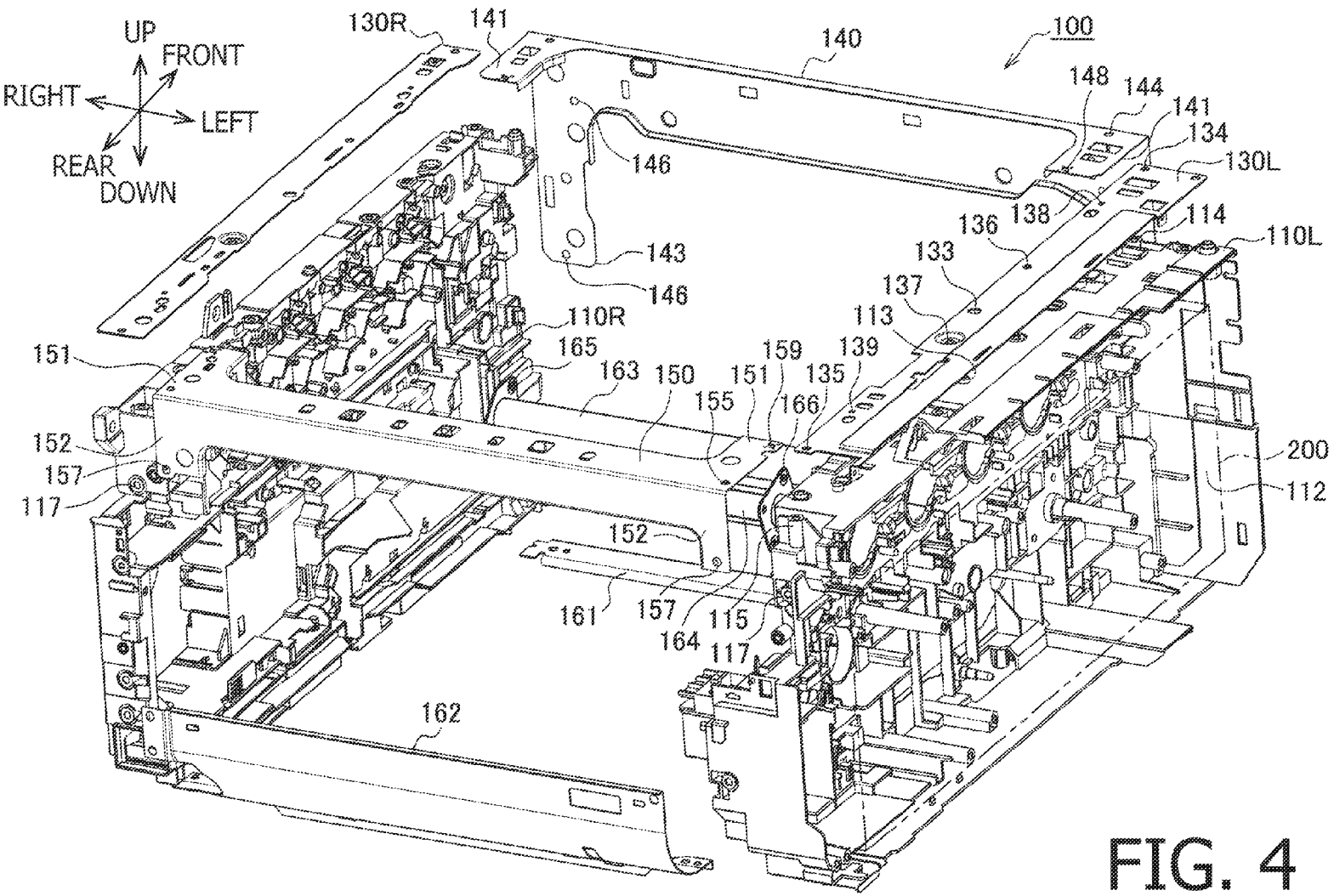
FIG. 4 is a perspective view of a rear side of the frame assembly in the image forming apparatus according to the embodiment of the present invention.

Inside the chassis 2, a frame assembly 100 is provided to support the sheet-feed tray 7, the belt unit 20, the processing units 30, and the fixing unit 50 laterally (from right and left). As shown in FIGS. 2-4, a pair of resin frames 110 are arranged to be parted from each other for an amount to accommodate the processing units 40. The resin frames 110 includes a resin frame 110R, which is arranged on a right-hand side, and a resin frame 110L, which is arranged on a left-hand side.

Each of the resin frames 110R, 110L is formed to have a known supporting structure to hold the sheet-feed tray 7, the belt unit 20, and the processing units 30 on an inner side thereof. Further, the resin frame 110L is formed to have a recess 112 (see FIG. 4), in which a driving unit 200 to drive the photosensitive drums 31 is disposed. The driving unit 200 is a known driving source including a motor and gear trains, which are not shown.

Each of the resin frames 110R, 110L is formed in a shape of an approximate rectangle with a four-sided (quadrangle) outer rim, when viewed from a lateral (right or left) side. On top faces of the resin frames 110R, 110L, thin metal-made top enhancing plates 130R, 130L are attached thereto by screws. A method to screw the top enhancing plates 130R, 130L to the resin frames 110R, 110L will be described later in detail. In between the resin frames 110R, 110L, beams and pipes to bridge over a gap between the resin frames 110R, 110L are arranged. In particular, at an upper front position of the resin frames 110R, 110L, a metal-made front beam 140 is arranged. At the upper rear position, a metal-made rear beam 150 is arranged. At lower front and lower rear positions, lower beams 161, 162 being a pair are arranged. Further, a pair of tubular metal pipes 163, 164 are arranged to link the mutually-facing inner planes of the resin frames 110R, 110L. Thus, the front beam 140, the rear beam, the lower beams 161, 162, and metal pipes 163, 164 link the resin frames 110R, 110L together.

The metal pipe 163 has a flange 165 at each axial end, and the metal pipe 164 has a flange 166 at each axial end. The flanges 165, 166 are screwed to the inner planes of the resin frames 110R, 110L respectively. The lower beam 161 is a thin and elongated metal plate, which is bent downward at a front end and a rear end thereof. The lower beam 161 is screwed to front bottoms of the resin frames 110R, 110L. The lower beam 162 is a thin and elongated metal plate, which is curved in an arc in a vertical cross-section. The lower beam 162 is screwed to rear bottoms and lower rear faces of the resin frames 110R, 110L.

The rear beam 150 is formed to have a cross-sectional shape of an L, when taken along a line orthogonal to a crosswise-extending direction thereof. The crosswise direction of the rear beam 150 coincides with the widthwise (right-left) direction of the image forming apparatus 1 when the rear beam 150 is arranged between the resin frames 110R, 110L in the image forming apparatus 1. Further, the rear beam 150 is formed to have upper overlapping sections 151 and rear overlapping sections 152. The upper overlapping sections 151 overlap rear areas of the upper faces of the resin frames 110R, 110L via the top enhancing plates 130R, 130L. The rear overlapping sections 152 overlap upper areas of rear faces of the resin frames 110R, 110L. The upper overlapping sections 151 and the rear overlapping sections 152 are formed to extend frontward and downward respectively from the widthwise-extending elongated part of the rear beam 150.

The front beam 140 is a thin and elongated metal plate, which extends in the widthwise direction along the front faces of the resin frames 110R, 110L, and is bent rearward at an upper edge thereof to have a cross section of an L. Further, the front beam 140 is formed to have upper overlapping sections 141, which overlap front parts of the upper faces of the resin frames 110R, 110L via the top enhancing plates 130R, 130L. The upper overlapping sections 141 are formed to extend rearward from the widthwise-extending elongated part of the front beam 140. Further, the front beam 140 is formed to have a side enhancing plate 142, which extends along the outer rim of the resin frame 110L to partially overlap the front face of the resin frame 110L. The side enhancing plate 142 is elongated downward along the front face of the resin frame 110L to reach a vicinity of a lower end of the resin frame 110L to overlap at least vertically 80% of the front face of the resin frame 110L. Furthermore, the front beam 140 is formed to have a side enhancing plate 143, which extends downward along the front face of the resin frame 110R to partially overlap the front face of the resin frame 110R. The side enhancing plate 143 is elongated beyond a vertical center of the front face of the resin frame 110R to overlap at least an upper half of the front face of the resin frame 110R.

Figures 5A, 5B:
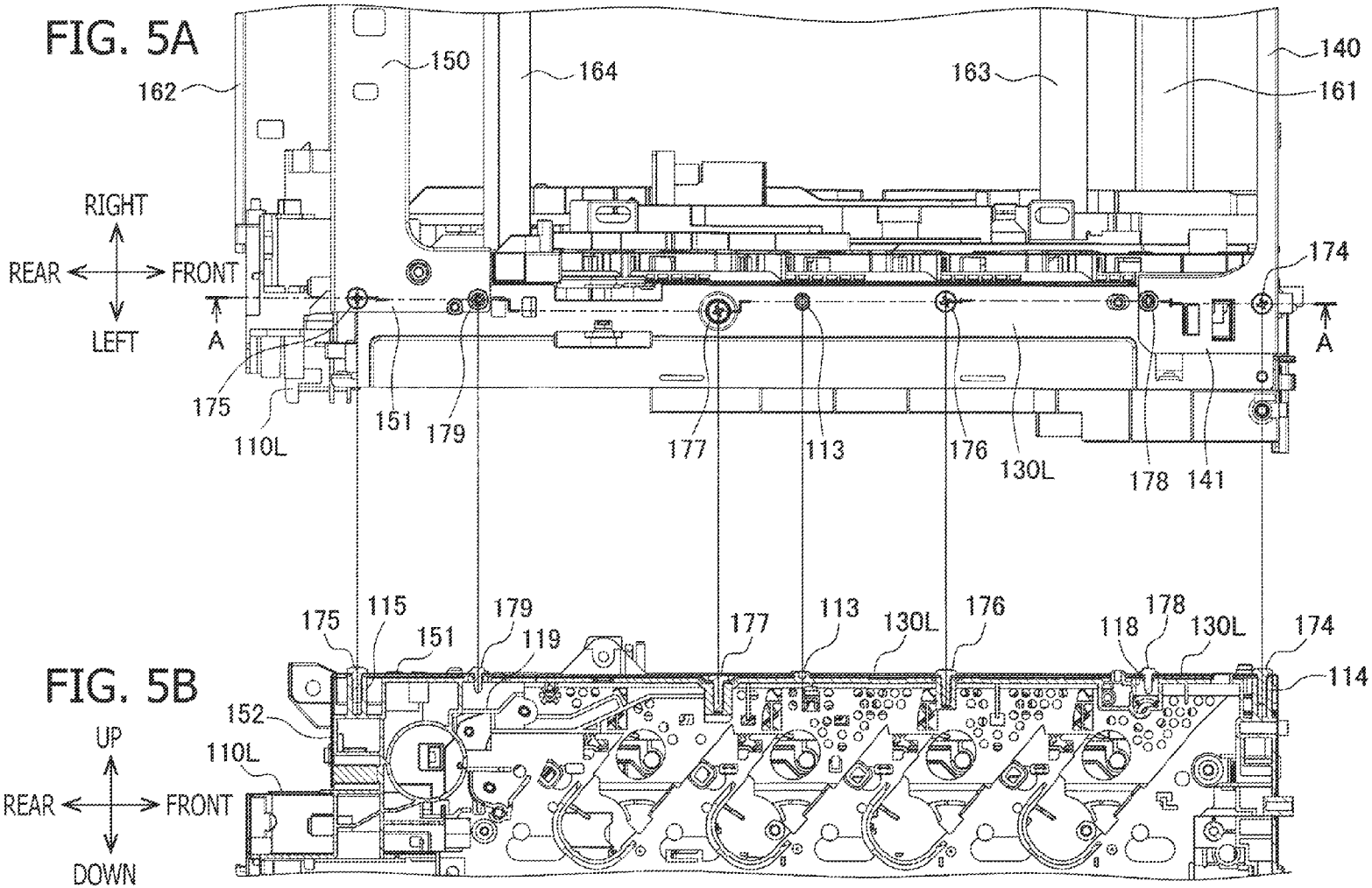
FIG. 5A is a top plane view of the frame assembly in the image forming apparatus according to the embodiment of the present invention.
FIG. 5B is a cross-sectional side view of the frame assembly in the image forming apparatus according to the embodiment of the present invention taken along a line A-A shown in FIG. 5A.

A structure to attach the upper enhancing plate 130L to the resin frame 110L will be described with reference to FIGS. 5A and 5B. Between FIGS. 5A and 5B, identical components viewed from different angles are connected with each other by thin lines to indicate the positional relations. Although not shown, the upper enhancing plate 130R is attached to the resin frame 110R in the similar attaching structure as the upper enhancing plate 130L shown in FIGS. 5A and 5B.

In a central position between the front end and the rear end of the upper face of the resin frame 110L, a boss 113 projecting upward is formed. Meanwhile, in a central position between the front end and the rear end of the upper enhancing plate 130L, a through hole 133 (see FIG. 4) is formed. The through hole 133 is formed in a size to have the boss 113 fitted there-into.

The resin frame 110L is formed to have lowered planes, which are lower than the top face of the resin frame 110L, at the upper front end and the upper rear end thereof, and cylindrical bosses 114, 115 are formed to protrude upwardly from the lowered planes. Meanwhile, the upper enhancing plate 130L is formed to have a length, along the front-rear direction, to extend over the cylindrical bosses 114, 115. In the upper enhancing plate 130L, in a position to coincide with the boss 114, a round opening 134 (see FIG. 4) is formed. Further, in the upper overlapping section 141 on the front side, in a position to coincide with the boss 114, a round opening 144 (see FIG. 4) is formed. Therefore, when the round opening 134 and the round opening 144 coincide with the boss 114, a tapping screw 174 (see FIG. 5) can be inserted through the round openings 134, 144 and screwed into an axial center of the boss 114. On the other hand, in the upper enhancing plate 130L, in a position to coincide with the boss 115, a round opening 135 (see FIG. 4) is formed. Further, in the upper overlapping section 141 on the rear side, in a position to coincide with the boss 115, a round opening 155 (see FIG. 4) is formed. Therefore, when the round opening 135 and the round opening 155 coincide with the boss 115, a tapping screw 175 (see FIG. 5) can be inserted through the round openings 135, 155 and screwed into an axial center of the boss 115. The bosses 114, 115 are provided to absorb difference between thermal expansion rates of the resin frame 110L and the upper enhancing plate 130L. More specifically, the resin frame 110L and the upper enhancing plate 130L thermally expand or contract with respect to the boss 113 and the through hole 133 respectively. Therefore, if the upper enhancing plate 130L is fixed to the front end and the rear end of the upper face of the resin frame 110L directly, the entire frame assembly may be distorted due to the difference in the thermal expansion rates. However, the bosses 114, 115, which can deform more flexibly with respect to the upper face of the resin frame 110L, can absorb the difference of thermal expansion rates between the resin frame 110L and the upper enhancing plate 130L. Therefore, height and thickness (diameter) of the bosses 114, 115 are calculated to absorb the difference of thermal expansion rates between the resin frame 110L and the upper enhancing plate 130L.

The upper enhancing plate 130L is formed to have round openings 136, 137 (see FIG. 4), through which tapping screws 176, 177 (see FIGS. 5A, 5B) are inserted, in positions closer to the through hole 133 than midst positions between the through hole 133 and the round openings 134, 135 respectively. The tapping screws 176, 177 are inserted through the round openings 136, 137 and screwed into the upper face of the resin frame 110L directly. Thus, the upper enhancing plate 130L is attached to the upper face of the resin frame 110L by engagement of the boss 113 fitting into the through hole 133 and the tapping screws 174, 175, 176, 177 screwed to the resin frame 110L. Although the resin frame 110L thermally expands or contracts with respect to the center of the boss 113, since the tapping screws 176, 177 are screwed to the resin frame 110L at the positions closer to the boss 113 than the midst positions between the boss 133 and the bosses 114, 115, amounts of the deformation in areas around the screwed (176, 177) positions are relatively small compared to deformation in areas further from the boss 113 (e.g., the front and rear end areas). Therefore, for the taping screws 176, 177, protrusive bosses to absorb the difference between the thermal expansion rates are not required.

On the front faces of the resin frames 110L, 110R, a plurality of protrusive bosses 116 (see FIG. 3) are formed. Meanwhile, in the side enhancing plates 142, 143, round openings 146 (see FIG. 3) are formed in positions to coincide with the bosses 116. A plurality of tapping screws (not shown) are inserted through the round openings 146 and screwed in the bosses 116. Thus, the front beam 140 is attached to the upper face of the resin frames 110L, 110R by engagement of the unshown tapping screws and the tapping screw 174 with the resin frames 110L, 110R. Similarly, on the rear faces of the resin frames 110R, 110L, a plurality of protrusive bosses 117 (see FIG. 4) are formed. Meanwhile, in the rear overlapping sections 152, round openings 157 are formed in positions to coincide with the bosses 117. A plurality of tapping screws (not shown) are inserted through the round openings 157 and screwed in the bosses 117. Thus, the rear beam 150 is attached to the rear faces of the resin frames 110L, 110R by engagement of the unshown tapping screws and the tapping screw 175 with the resin frames 110L, 110R.

Further, the front beam 140 is formed to have a round opening 148, through which a screw 178 (FIG. 5) is inserted, in a rear end position of the upper overlapping section 141. Meanwhile, in the upper enhancing plate 130L, a screw hole 138 with a burr-enhanced edge is formed in a position to coincide with the round opening 148, and in the resin frame 110L, a recess 118 (FIG. 5) is formed in a position to coincide with the round opening 148. Similarly, the rear beam 150 is formed to have a round opening 159, through which a screw 179 (see FIG. 5) is inserted, in a front end position of the upper overlapping section 151. Meanwhile, in the upper enhancing plate 130L, a screw hole 139 with a burr-enhanced edge is formed in a position to coincide with the round opening 159, and in the resin frame 110L, a recess 119 (see FIG. 5) is formed in a position to coincide with the round opening 159.

Whilst the screw 178 (see FIGS. 5A, 5B) is inserted through the round opening 148 and screwed into the screw hole 138, with the recess 118 formed in the resin frame 110L, the screw 178 is not fixed to the resin frame 110L but is movable with respect to the resin frame 110L and couples the upper enhancing plate 130L with the front beam 140. Similarly, whilst the screw 179 (see FIGS. 5A, 5B) is inserted through the round opening 159 and screwed into the screw hole 139, with the recess 119 formed in the resin frame 110L, the screw 179 is not fixed to the resin frame 110L but is movable with respect to the resin frame 110L and couples the upper enhancing plate 130L with the rear beam 150. Thus, with the above-described flexible attaching structure, along with the deformation-absorbable bosses 114, 115, the screws 178, 179 can move in accordance with the difference in the thermal expansion rates between the resin frame 110L and the upper enhancing plate 130L to absorb the stress, which may otherwise be applied to the resin frame 110L.

Effects and More Examples

As has been described above, in the frame assembly 100, the front beam 140 is attached to the pair of upper enhancing plates 130L, 130R by the screws 174, 178. Meanwhile, the rear beam 150 is attached to the pair of upper enhancing plates 130L, 130R by the screws 175, 179. Thus, the upper enhancing plates 130L, 130R, the front beam 140, and the rear beam 150 are in conjunction with one another to form a four-sided (e.g., rectangle, square) opening in a plane view. Therefore, rigidity of the front beam 140 and the rear beam 150 attached to the resin frames 110L, 110R, is secured by the upper enhancing plates 130L, 130R. Accordingly, the rigidity of the entire frame assembly 100 including the resin frames 110L, 110R can be improved.

According to the embodiment described above, it is not necessary that the resin frames 110L, 110R are fully covered by metal plates to be enhanced, but the resin frames 110L, 110R are partially covered by the metal upper enhancing plates 130L, 130R, the front beam 140, and the rear beam 150. Therefore, a total amount of metal to be used in the frame assembly 100 can be smaller, and manufacturing cost for the image forming apparatus 1 and weight thereof can be effectively reduced. Further, since the front beam 140 and the rear beam 150 are formed to have the shapes of L in the cross section, which is taken orthogonally with respect to the cross-wise-extending direction of the beams 140, 150, the front beam 140 and, specifically, the rear beam 150 can provide preferable rigidity. Thus, the weight of the image forming apparatus 1 can be reduced to be lighter whilst the rigidity can be maintained or improved.

Further, the resin frames 110L, 110R are reinforced at the front faces by the metal-made side enhancing plates 142, 143, which are formed in continuity with the front beam 140. Therefore, the resin frames 110L, 110R are more firmly enhanced, and rigidity of the frame assembly 100 can be improved. In particular, deformation of the resin frames 110L, 110R at upper front corners can be effectively prevented. Further, the resin frame 110L, on which the driving unit 200 is disposed, is designed to bear a greater load than the resin frame 110R. However, the side enhancing plate 142 enhancing the resin frame 110L is formed to be larger than the side enhancing plate 143 enhancing the resin frame 110R. Therefore, the rigidity of the entire frame assembly 100 can be preferably maintained. Furthermore, with the pair of lower beams 161, 162 and the metal pipes 163, 164 bridged between the resin frames 110L, 110R, the rigidity of the frame assembly 100 can be preferably improved.

According to the image forming apparatus 1 described above, the LED units 40 are separated from the photosensitive drums 31 when the top cover 5 is opened, and the processing units 30 and the belt unit 20 can be lifted upward to be removed out of the chassis 2 through the opening enclosed by the upper enhancing plates 130L, 130R, the front beam 140, and the rear beam 150. Thus, openness provided by the upper enhancing plates 130L, 130R, the front beam 140, and the rear beam 150 can be effectively utilized.

Although an example of carrying out the invention has been described, those skilled in the art will appreciate that there are numerous variations and permutations of the image forming apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the side enhancing plates, which are formed in continuity with the front beam 140 and the rear beam 150, may be laid side-by-side or over the upper enhancing plates 130 to be arranged along the upper faces of the resin frame 110. For another example, the metal pipes 163, 164 may be four-sided (rectangular or square) columns or partially-cutout cylinders or columns, of which cross-sections are in a shape of C or U.

What is claimed is:

1. An image forming apparatus, comprising:

an image forming unit configured to form an image on a recording medium and comprising a processing unit including a photosensitive member;

a pair of lateral frames made of resin and configured to directly support at least the processing unit in the image forming unit at laterally opposite sides of the processing unit;

a pair of metal-made top enhancing pieces arranged on top of upper faces of the lateral frames, each of the metal-made top enhancing pieces being formed independently from the lateral frames; and a pair of first metal beams, each of which is arranged to bridge over a position between the paired top enhancing pieces and forms a four-sided opening in conjunction with each other and with the paired top enhancing pieces, wherein the pair of metal-made top enhancing pieces and the pair of first metal beams are arranged to overlap each other at end portions thereof, at which the pair of metal-made top enhancing pieces and the pair of first metal beams are fixed to the upper faces of the lateral frames by screws.

2. The image forming apparatus according to claim 1, wherein at least one of the first metal beams is formed to have a cross-sectional shape of an L, when taken along an orthogonal direction with respect to a crosswise-extending direction thereof.

3. The image forming apparatus according to claim 1, wherein at least one of the first metal beams is formed in continuity with a metal-made side enhancing piece, which reinforces an outer rim of at least one of the paired lateral frames.

4. The image forming apparatus according to claim 3, wherein the side enhancing piece is arranged to extend along the outer rim of the at least one of the lateral frames on a face which adjoins the upper face of the at least one lateral frame.

5. The image forming apparatus according to claim 3, wherein a driving unit to drive the image forming unit is disposed on the at least one of the lateral frames.

6. The image forming apparatus according to claim 1, further comprising:

a pair of second metal beams, which are arranged between the paired lateral frames to link the mutually facing planes of the paired lateral frames.

7. The image forming apparatus according to claim 1, wherein the image forming unit comprises:

a processing unit including a photosensitive member configured to form an image, which corresponds to a latent image formed on the photosensitive member, in a developer agent on the recording medium; and an exposure unit configured to expose the photosensitive member to light and form the latent image on the photosensitive member, and wherein at least a part of the processing unit is removably installed in the image forming apparatus through the opening.

8. The image forming apparatus according to claim 1, wherein each of the first metal beams and each of the upper enhancing pieces are fixed by a screw to each of the lateral frames.

9. The image forming apparatus according to claim 1, wherein each of the lateral frames is formed to have lower planes, which are lower than the upper face of the lateral frame, and bosses, which are formed to protrude upwardly from the lower planes; and wherein the upper enhancing pieces are fixed to the lateral frames by screws to the bosses formed on the lower planes of the lateral frames.

10. An image forming apparatus, comprising:

an image forming unit configured to form an image on a recording medium and comprising a processing unit including a photosensitive member;

a pair of lateral frames made of resin and configured to support at least the processing unit in the image forming;

a pair of metal-made top enhancing pieces arranged on top of upper faces of the lateral frames, each of the metal-made top enhancing pieces being formed independently from the lateral frames; and a pair of first metal beams, each of which is arranged to bridge over a position between the paired top enhancing pieces and forms a four-sided opening in conjunction with each other and with the paired top enhancing pieces, wherein the pair of metal-made top enhancing pieces and the pair of first metal beams are arranged to overlap each other at end portions thereof, at which the pair of metal-made top enhancing pieces and the pair of first metal beams are directly coupled to the upper faces of the lateral frames with screws, the metal-made top enhancing pieces and the pair of first metal beams being movable with respect to the lateral frames.

11. The image forming apparatus according to claim 10, wherein at least one of the first metal beams is formed to have a cross-sectional shape of an L, when taken along an orthogonal direction with respect to a crosswise-extending direction thereof.

12. The image forming apparatus according to claim 10, wherein at least one of the first metal beams is formed in continuity with a metal-made side enhancing piece, which reinforces an outer rim of at least one of the paired lateral frames.

13. The image forming apparatus according to claim 12, wherein the side enhancing piece is arranged to extend along the outer rim of the at least one of the lateral frames on a face which adjoins the upper face of the at least one lateral frame.

14. The image forming apparatus according to claim 12, wherein a driving unit to drive the image forming unit is disposed on the at least one of the lateral frames.

15. The image forming apparatus according to claim 10, further comprising:

a pair of second metal beams, which are arranged between the paired lateral frames to link the mutually facing planes of the paired lateral frames.

16. The image forming apparatus according to claim 10, wherein the image forming unit comprises:

a processing unit including a photosensitive member configured to form an image, which corresponds to a latent image formed on the photosensitive member, in a developer agent on the recording medium; and an exposure unit configured to expose the photosensitive member to light and form the latent image on the photosensitive member; and wherein at least a part of the processing unit is removably installed in the image forming apparatus through the opening.

* * * * *